US006565683B1

(12) United States Patent
Utyashev et al.

(10) Patent No.: US 6,565,683 B1
(45) Date of Patent: May 20, 2003

(54) METHOD FOR PROCESSING BILLETS FROM MULTIPHASE ALLOYS AND THE ARTICLE

(75) Inventors: Farid Zainullaevich Utyashev, Ufa (RU); Oscar Akramovich Kaibyshev, Ufa (RU); Vener Anvarovich Valitov, Ufa (RU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/194,798

(22) PCT Filed: Jun. 19, 1997

(86) PCT No.: PCT/US97/10674

§ 371 (c)(1),
(2), (4) Date: Feb. 14, 2000

(87) PCT Pub. No.: WO97/48831

PCT Pub. Date: Dec. 24, 1997

(30) Foreign Application Priority Data

Jun. 21, 1996 (RU) ..... 96112649

(51) Int. Cl.[7] ..... C22F 1/10; C22F 1/18; C22D 8/00

(52) U.S. Cl. ..... 148/624; 148/677; 148/676; 148/671

(58) Field of Search ..... 148/677, 624, 148/676, 671

(56) References Cited

U.S. PATENT DOCUMENTS 3,975,219 A * 8/1976 Allen et al. ..... 148/11.5
4,345,950 A * 8/1982 O'Hara ..... 148/2
4,612,062 A * 9/1986 Nazmy et al. ..... 148/11.5
5,374,323 A * 12/1994 Kuhlman et al. ..... 148/677
5,665,180 A * 9/1997 Seetharaman et al. ..... 148/527
5,693,159 A * 12/1997 Athey et al. ..... 148/677
5,759,305 A * 6/1998 Benz et al. ..... 148/514

OTHER PUBLICATIONS

Mataya et al., "Effects of Multiple Reductions on Grain Refinement During Hot Working of Alloy718", Superalloy 718–Metallurgy and Applications, Edited by E.A. Loria, The Minerals, Metals & Materials Society, 1989, pp. 155–178.

Kaufman et al., "High Quality, High Strength Alloy 718 Billet Material Using Fine–Grain Conversion Practice", Superalloy 718–Metallurgy and Applications, Edited by E.A. Loria, The Minerals, Metals & Materials Society, 1989, pp. 189–198.

(List continued on next page.)

*Primary Examiner*—George Wyszomierski
*Assistant Examiner*—Janelle Combs Merillo
(74) *Attorney, Agent, or Firm*—Noreen C. Johnson; Philip D. Freedman

(57) ABSTRACT

The invention relates to plastic working of metals and alloys, predominantly low-plastic and hard-to-work ones, e.g., nickel-, titanium-, and iron-base high-temperature alloys, and producing billets for parts made by plastic working of said billets. The method comprises thermomechanical processing which is performed beginning with the temperature at which a total content of precipitates or an allotropic modification of the matrix exceeds 7%, followed by a stage-by-stage decrease of the working temperature down to the temperature at which a stable fine-grained microstructure of the material is obtained, with ratio between the grain size of various phases differing by not more than 10 times, the billet under processing undergoes deformation with a 1.2 to 3.9 times change in the billet cross-sectional area. When preparing billets from nickel-base alloys a stage-by-stage decrease of the working temperature is carried out so as to provide a maximum 14% gain in the γ-phase at each stage. At the end of each process stage a successive annealing of the billet is performed.

2 Claims, 5 Drawing Sheets a

OTHER PUBLICATIONS

Mahoney, "Superplastic Properties of Alloy 718", Superalloy 718–Metallurgy and Applications, Edited by E.A. Loria, The Minerals, Metals & Materials Society, 1989, pp. 391–405.

Raymond, "Effect of Chemistry and Processing on the Structure of Mechanical Properties of Inconel Alloy 718", Superalloy 718–Metallurgy and Applications, Edited by E.A. Loria, The Meinerals, Metals & Materials Society, 1989, pp. 577–587.

Perri et al., "Ultra Fine Grain Processed UDIMET(R) Alloy 718 for Isothernal Forging", Superalloy 718–Metallurgy and Applications, Edited by E.A. Loria, The Minerals, Metals & Materials Society, 1997, pp. 267–277.

Zhang et al., "Effect of Hot Deformation Parameters in the Grain Size of Wrought IN718", Superalloy 718–Metallurgy and Applications, Edited by E.A. Loria, The Minerals, Metals & Materials Society, 1997, pp. 183–192.

* cited by examiner a b a b

METHOD FOR PROCESSING BILLETS FROM MULTIPHASE ALLOYS AND THE ARTICLE

FIELD OF THE INVENTION

The present invention relates in general to plastic metal working and more specifically to methods for producing billets from low-plastic and hard-to-work materials, predominantly from nickel-, titanium-, and iron-base high-temperature alloys.

BACKGROUND OF THE INVENTION

The aforementioned alloys find widespread use in modern constructions of power plants and in aerospace engineering. Although said alloys have high temperature strength and resistance to gas corrosion, they are poorly processable due to low plasticity and high strain resistance. This in turn involves high labor-, power-, and material consumption of processes for producing parts from said alloys using metal-working techniques. Special difficulties are encountered in producing billets from superalloys for large-diameter intricate-configuration parts.

A method for processing billets is widely known heretofore as Gatorizing™ (U.S. Pat. No. 3,519,503, 1970). Hard-to-work alloys are processed, according to said method, in two steps. At the first step a fine-grained microstructure is established in the intermediate product by heating the billet to a temperature somewhat lower than the temperature of normal recrystallization and intense plastic deformation involving the ratio of a reduction of cross-sectional area not less than 4:1, press-forming being the predominant deformation technique used for the purpose. However, said technique requires use of high-power pressing equipment due to high straining force involved. At the second step the intermediate product having a fine-grained microstructure undergoes die-forging under superplasticity conditions. Finally, the billet is subjected to finish heat-treatment with a view to restoring its temperature strength. However, the Gatorizing™ process fails to establish a specified microstructure of the billet material.

On the other hand, quite a number of parts from nickel-base superalloys, such as integral rotors, operate under complicated working conditions, whereby it is expedient that special inhomogeneous states of microstructure be established in the various zones of such parts so as to provide an optimum set of properties meeting the actual working conditions of such parts. This, however, is unattainable with the Gatorizing™ process.

One prior-art differential heat-treatment is known (U.S. Pat. No. 3,741,182, 1973), wherein the blade assembly of an integral rotor is subjected to high-heat treatment to form a coarse-grained microstructure therein, whereas the disk of the rotor retains its fine-grained microstructure. The results are that the finished integral rotor has mechanical properties approximating the optimum ones.

SUMMARY OF THE INVENTION

The present invention has for its object to provide a method for processing high-temperature alloys, instrumental in establishing specified microstructures in billets of machine parts, both cross-sectionally homogeneous and inhomogeneous, ensuring high technological plasticity when subjected to plastic working, as well as optimum performance characteristics in finished machine components.

The authors of the present invention have discovered quite unexpectedly that the aforesaid object can be accomplished by combining multistep heat-treatment of a billet under certain appropriate temperature conditions and its plastic deformation. Such a processing will hereinafter be referred to as thermomechanical processing.

According to the present invention, thermomechanical processing includes the following steps: heating the billet to a temperature at which a total content of precipitated phases or an allotropic modification of the alloy matrix exceeds 7%, followed by a stepwise decreasing of the process temperature down to a temperature at which a stable fine-grained microstructure is obtained, wherein the ratio between the grain sizes of different phases is not in excess of 10, and billet reduction at the first and each of the following steps of temperature decreasing, with a degree of the billet reduction at each step being a multiple of 1.2 to 3.9 times the change in the billet cross-sectional area.

The foregoing object is accomplished due to preparing the microstructure of billets made from high-temperature nickel-base alloys using the same thermomechanical processing, by a stage-by-stage reduction of the billet processing temperature so as to provide a maximum 14% gain in the γ-phase at each stage, and performing post-deformation annealing at the end of each stage of the thermomechanical processing at a temperature not exceeding that at the beginning of the deformation process at the preceding stage.

Of importance for accomplishing the object of the present invention is also the billet strain rate which at the first stage is expedient to be $10^{-2}$ to $10^{-3}$ $s^{-1}$, and the following stages be changed in accordance with the following relationship:

$$\epsilon_{\eta}=K_{\phi}\cdot\epsilon_{\eta\rho}\cdot T_d/T_{\eta\rho\phi}$$

where $\epsilon_{\eta}$—strain rate at a next stage;

$\epsilon_{\eta\rho}$—strain rate at a preceding stage;

$T_d$—deformation temperature;

$T\eta\rho\phi$—temperature of the second phase complete dissolution;

$K_{\phi}$—empirical coefficient depending on the chemical and phase composition of the alloy ($K_{\phi}$=0.5–2).

High alloys with predominantly a cast structure, as well as low alloys, are subjected, according to the present invention, to a preliminary thermomechanical processing in a temperature range from 0.95 m.p. of the alloy to a temperature at which the secondary phase content of the alloy is not above 7%, where the processing is carried out with a stepwise temperature decrease, while controlling the alloy temperature and processing temperature and the strain rate at each stage.

Prior to the billet reduction step, it is expedient to place the billet in a heat-insulating container.

One of the specific features of the present invention is the fact that formation of a specified microstructure of the material continues also at the step of subsequent plastic deformation aimed at imparting to the billet the shape of a future finished part by, e.g., rolling said billet.

Prior to said plastic deformation, according to the present invention, the billet is subjected to additional annealing in a monophase region at a temperature not above 1.07 the temperature of the γ-phase complete dissolution, followed by cooling at a rate ensuring a gain in the γ-phase from about 5% per hour to about 50% per hour, and said additional deformation is carried out at a temperature below the temperature of the γ-phase's complete dissolution. It is expedient that said additional billet annealing be performed in at least two adjacent billet portions so as to establish a temperature gradient there between, the temperature being changed in the range from 0.8 the temperature of complete dissolution of the γ-phase in one billet portion to a temperature not above 1.07 the temperature of complete dissolution of the γ-phase in the other billet portion.

Said additional billet deformation is carried out after a local shaping pattern occurs in two steps. At the first step the billet is subjected to deformation in a temperature range of superplasticity until the billet size is equal to about 0.6–0.9 of the part's final size, and at the second step the billet undergoes further deformation until the final part size is obtained, said step being preceded by annealing the billet in a monophase region.

Additional deformation (after a local shaping pattern) in at least two adjoining billet portions is expedient to be carried out with different degrees of reduction varying steadily from one billet portion to another by about 0.25 to 0.75 the degree of reduction of the adjacent billet portion.

BRIEF DESCRIPTION OF THE DRAWINGS

In what follows the method proposed in the present invention is illustrated with the aid of the accompanied drawings, wherein.

DESCRIPTION OF THE INVENTION

Figure 1:
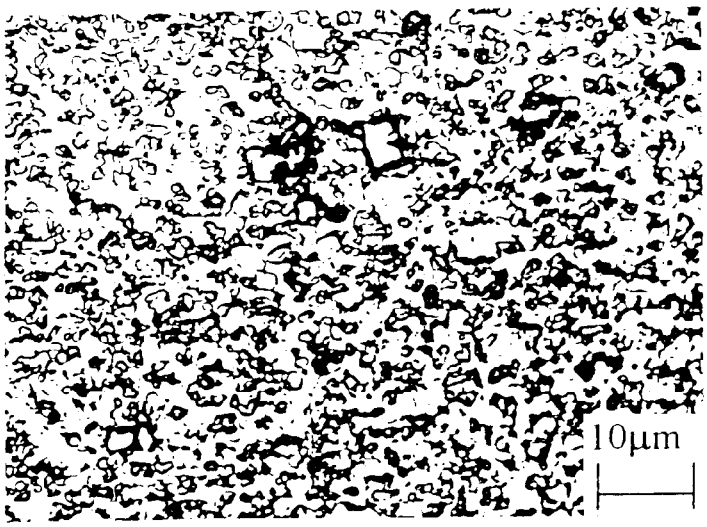
FIG. 1 shows the microstructure of the A962 (a) and A975 (b) alloys after thermomechanical processing.
Figure 1:
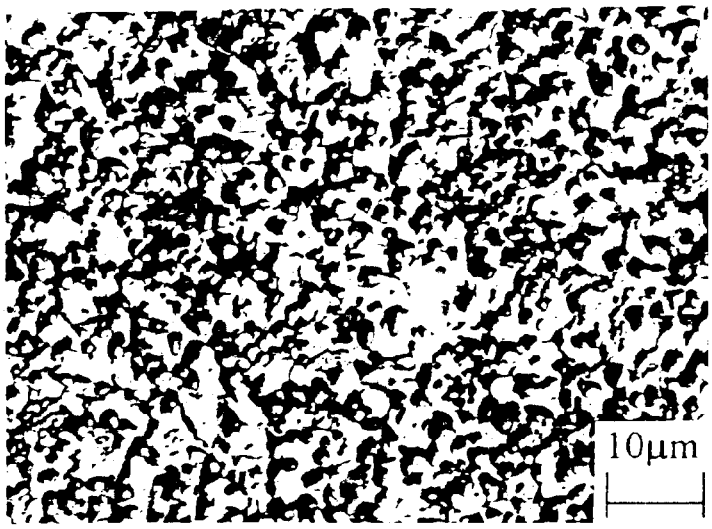

Preparing the microstructure of the billet material consists either in thermomechanical processing with a view of obtaining a homogeneous fine-grained microstructure in the aforementioned Ni-, Ti-, and Fe-base multiphase alloys or in obtaining a special heterogeneous s-billet structure. In both cases the method, according to the invention, is aimed at establishing a specified billet microstructure.

According to the essence of the present invention, in order to establish a homogeneous fine-grained microstructure of the billet, its thermomechanical processing starts from a temperature at which a total second-phase content of the alloy is not below 7%. The grain size in the second-phase fine-grained structure that has been prepared by thermomechanical processing should not differ from the grain size in the alloy matrix by more than ten times. It is under such conditions that the fine-grained structure thus obtained becomes stable. The aforementioned conditions determine the deformation temperature range in which the deformation results in grain refining due to dynamic or static recrystallization occurring in the alloys.

A stage-by-stage decreasing of the process temperature is necessary for a successive increase in the content of the second phase or an allotropic matrix modification, whereby the grains are refined from stage to stage and stable fine-grained microstructure states are obtained until the so-called nanocrystalline state is attained.

It is necessary that for nickel-base alloys containing a considerable proportion (up to 60–70%) of second phases and wherein recrystallization is controlled by the processes of precipitation and coagulation of the γ-phase, the conditions for the γ-phase precipitation and, accordingly, the temperature conditions at each process stage be specified. It is expedient that a gain in the γ-phase does not exceed about 14% at each stage, as otherwise an abrupt reduction of plasticity occurs due to an additional precipitation of a considerable amount (over 14%) of the γ-phase, said reduction resulting in disturbed continuity of the material during its plastic deformation. On the other hand, in titanium-base alloys containing plastic phases which produce no abrupt embrittling effect, it is preferable to specify an additional precipitation of the other phase. This is due to the fact that a rather abrupt temperature decrease in transition from one stage to another together with a higher second-phase content results in retarding the diffusion processes which hampers transformation of laminated structure into a globular one.

Repeated deformation of nickel-base alloys alternating with intermediate annealing results in a gradual refined microstructure. It is due to many repeated alternative operations of strain hardening and softening of the material due to the development of primary recrystallization of the alloy so that an ultrafine-grained microstructure is formed, consisting of the grains of an equilibrium (at the process temperature) solid solution of the γ-phase and the grains of the γ-phase, i.e., the so-called microduplex structure. The deformation at each stage should provide a about 1.2 to 3.9 times change in the initial cross-sectional area. The cross-sectional area is to be changed by not more than four times per stage, since otherwise the continuity of the material may be disturbed, especially during the upsetting procedure which is used for preparing the billet for rolling. With the degree of deformation below about 1.2, grain size variation may occur, whereas in the range from about 1.2 to 3.9, is sufficient for intensifying the processes of coagulation of the particles of the γ-phase, increasing particle size and interparticle spacing, as well as accumulation and redistribution of flaws. Thus, favorable conditions are provided for dynamic and static recrystallization to occur at each stage. The degrees of deformation used in the proposed method are substantially below that those used in the known method, which makes possible use of lower-power pressing equipment.

With a view to providing the most complete recrystallization processes for nickel-base alloys, wherein diffusion processes during second-phase dissolution, precipitation, and growth determine the development of recrystallization and take a definite period of time, post deformation annealing is to be performed at the end of each stage without applying a load or with applying a load (dynamic annealing). Said annealing causes structural changes which provide formation of fine-grained miscrostructure and at the subsequent stage it adds to plasticity and reduces strain resistance.

On the other hand, as far as titanium-base alloys are concerned, wherein the deformation process is accompanied by intense development of dynamic recrystallization resulting in the formation of a fine-grained microstructure, post deformation annealing between the stages is not obligatory. As far as other materials are concerned, e.g., iron-base age-hardenable austenitic alloys, they require a shortened period of post deformation annealing procedures which should be carried out concurrently with the heating for the next deformation stage.

As regards the strain rate it has been found empirically that at the first stage it is most preferable to be in the range of from $10^{-2}$ to $10^{-3}$ $s^{-1}$, while at the following stages the strain rate is to be controlled in keeping with the following relationship:

$$\epsilon_{\eta}=K_{\phi}\cdot\epsilon_{\eta\rho}T_d/T_{\eta\rho\phi}$$

where $\epsilon_{\eta}$—strain rate at a next stage;

$\epsilon_{\eta\rho}$—strain rate at a preceding stage;

$T_d$—deformation temperature;

$T\eta\rho\phi$—temperature of the second phase complete dissolution;

$K_{\phi}$—empirical coefficient depending on the chemical and phase composition of the alloy ($K_{\phi}$=0.5–2).

The physical sense of this relationship is that in the case of a stage-by-stage working temperature reduction towards lower homologous temperatures, a substantial retarding of the diffusion processes (coagulation and dissolution of the second phases) is possible. Therefore, it is reasonable to reduce the strain rate from stage to stage to the values at which the diffusion processes in the material have enough time to proceed to an adequate extent so as to promote the development of recrystallization at lower homologous temperatures.

Preliminary thermomechanical processing may be applied to both a billet produced by powder metallurgical techniques and to a conventional cast billets. However, it is important that a cast billet be subjected to conventional homogenizing annealing in the specified temperature range and, whenever necessary, to processing in a constant gas-pressure cabinet to eliminate porosity. According to the proposed method, alloys featuring large coarsened cast structures are required to undergo additional thermomechanical processing in a temperature range from about 0.95 m.p. of the alloy to the temperature at which the second phase content does not exceed 7%. The billet processing is to be performed also with a stage-by-stage temperature reduction and by controlling the temperature and the strain rate at each stage. It is necessary to apply such processing also to low alloys which have a broad temperature range of a monophase state, wherein said alloys exhibit high plasticity.

Preliminary thermomechanical processing of billets at high homologous temperatures promotes eliminating chemical and phase heterogeneity and metallurgical defects, while stage-by-stage temperature reduction in the monophase region contributes to progressive refining of the matrix grains. The working of the billet at each stage may be carried out either at a constant deformation temperature or at that varying throughout the stage. In the later case a temperature change is followed by a proportion change in the strain rate. This is accounted for by the fact that under the conditions of the actual technological process there may occur either cooling of the material due to, e.g., its interstage cooling down which results in a badly affected plasticity thereof, or strain heating of the material leading to coarsening of its microstructure and grain size variation. The undesirable effect of the temperature changes on the microstructure can be eliminated by appropriate changes in the strain rate depending on the temperature conditions of the deformation process.

Since thermomechanical processing conditions are to be specified, they should be performed either under isothermal conditions, or under those conditions approximating such. In order to provide the conditions approximating the isothermal ones (i.e., quasi-isothermal), heavy billets are recommended to be placed in a heat-insulating container.

In modern and perspective products for use in power plants and in aerospace engineering, an improved level of performance characteristics is provided due to the formation of a specific grain-boundary and intragranular structure therein, e.g., of the "necklace"-type, as well as coarse-grained microstructure with the serrated grain boundaries resulting from the complex thermomechanical processing. In addition, as has been mentioned before, it is necessary to form the specified microstructure over the part's cross-section in order to provide a set of properties optimized in view of the actual operating conditions.

When a special microstructure is to be obtained, e.g., that of the "necklace"-type which is either homogeneous or specifically changing over the cross-section of a part made of high-temperature nickel-base alloys, according to the present invention, the above described thermomechanical processing of a billet is combined with its plastic deformation in the form of, e.g., rolling which is expedient to be done concurrently with imparting to the billet the shape of the part to be produced.

The deformation process is preceded by an additional annealing by heating the billet in the monophase region at a temperature not higher than 1.07 of the temperature of complete dissolution of the γ-phase. Specific annealing temperatures and holding times are selected depending on the initial and preset final microstructure parameters in the whole billet or in a portion thereof. In the later case it is important to use a billet with the prepared fine-grained microstructure. This is followed by cooling from the annealing temperature to a temperature not exceeding the deformation temperature, at a constant or varying rate that provides a gain in the second phase from about 5% per hour to about 50% per hour, whereupon the billet undergoes deformation under temperature-rate conditions of superplasticity at a temperature below the temperature of the γ-phase complete dissolution.

The controlled cooling from the recrystallization temperature carried out in a range of cooling rates that provide the γ-phase gain in the range of not less than 5% per hour to not more than 50% per hour, allows uniformly precipitating the dispersed γ-phase inside the matrix grains. Cooling the alloy from the recrystallization temperature at a rate below about 5% per hour results in an excess γ-phase coagulation, its coarsening, and the formation of wide boundary areas that are free from precipitation, with the resultant recrystallization during subsequent deformation which establishes a structure of the micro-duplex type. Furthermore, low cooling rates result in undesirable precipitation of carbide phases with unfavorable morphology. On the other hand, the cooling rate above about 50% per hour results in precipitation of the dispersed γ-phase which badly affects the plasticity of the processed material. Cooling of the alloys in the preselected range of rates and the following deformation under the superplasticity temperature-rate conditions, allow the producing of a stable substructure inside the thermally strained grains. The cooling process running at constant or varying rates, allows obtaining the required second-phase morphology, which is of paramount importance for forming optimum structure states so as to ensure the required set of properties. The structure type varies substantially depending on the degree of final strain. About 55–75% strain provides a complete process ability of the material and establishes a stable "necklace"-type structure that is homogeneous over the entire part volume. This structure state is optimal for providing high strength and low-cycle fatigue at moderate temperatures (450–650° C.). As the degree of deformation decreases from about 55% to 35%, the proportion of the fine-grained component in the "necklace" structure decreases, with the metallographic texture decreasing, too. After about a 15–35% reduction, the formation of a coarse-grained structure with serrated grain boundaries occurs, whose strength characteristics are inferior to those of the "necklace" structure. However, said structure exhibits higher temperature-strength characteristics due to its being free from a fine-grained plastic interlayer between coarse thermally strained grains. A structure with the serrated grain boundaries possesses the highest temperature-strength characteristics at elevated temperatures (650–750° C.).

Deformation proceeds at strain rates corresponding to the high- low-plastic state of the material. The high-plastic state is present in the alloys under consideration in the case of rolling a fine-grained billet at high strain rates ($10^2$ to $10^{-2}$ $s^{-1}$), or rolling a coarse-grained billet at low strain rates ($10^{-2}$ to $10^{-3}$ $s^{-1}$). Whenever a mixed microstructure has been established in the billet, consisting of fine and coarse grains, the strain rate is selected also in the range of $10^2$ to $10^{-3}$ $s^{-1}$, depending on the volume ratio of the structural components (i.e., the fine- and coarse-grained ones) and on their size, respectively.

Predeformation annealing of the billet may be performed in at least two adjacent billet portions so as to establish a temperature gradient there between, the temperature being changed in the range from about about 0.8, the temperature of complete dissolution of the γ-phase in one billet portion, to a temperature not above about 1.07 the temperature of complete dissolution of the γ-phase in the other billet portion.

Such a step is necessary for establishing in the processing of the part, a steady grain size variation from fine-grain size in the part portion heated to about 0.8 the temperature of the γ-phase complete dissolution to coarse-grain size in the part portion heated to about 1.07 the temperature of the γ-phase complete dissolution, wherein a structure of the "necklace"-type is established, resulting from final deformation.

A similar effect can be obtained in the case where the local shaping is carried out in at least two adjoining billet portions with the different degrees of reduction varying steadily from one billet portion to another by about 0.25 to 0.75 of the degree of reduction of the adjacent billet portion. Thus, it is due to a specified change in the degree of reduction of one billet portion to another that the desirable change in the microstructure and mechanical properties over the cross-sectional area of a disk-type part can be obtained.

It is also noted that when producing parts with the preselected specified microstructure from billets with prepared fine-grained microstructure, recrystallization annealing be carried out during the final deformation procedure rather than after. thermomechanical processing, where said final deformation is being performed by, e.g. a local shaping technique, i.e. rolling. It is expedient that additional deformation is carried out in two steps, i.e., at the first step the billet is reduced, in the superplasticity temperature range, to the size equalling about 0.6–0.9 of the final part size, and at the second step the billet reduction is carried out until the final part size is obtained. It is important that the billet be annealed in the monophase region between said first and second steps.

Thus, due to billet size reduction to definite preset limits under superplasticity conditions, wherein the billet has a fine-grained microstructure, the process becomes more economic.

At the second step of the billet size reduction, when a coarse-grained microstructure with intragrain dispersed γ-phase precipitations is therein established, resulting from annealing and cooling, the deformation process is carried out at low strain rates to establish a special preselected microstructure.

Given below are exemplary embodiments of preparing the microstructure of billets for producing parts having a specified microstructure and properties.

Used as the starting material for carrying out the method is an iron-base alloy (A-286) of the following composition: Fe-25Ni-15Cr-2Ti-1.5Mn-1.3Mo, balance iron. Also nickel-base alloys, grades 3698, A962, and A975, differing in chemical composition and in the amount of the γ-phase, ranging from 24% to 55% are used. Originally, said alloys appear as billets 150–200 mm in diameter which have been produced from castings, using conventional press-forming or hot forging technique 3698, A975, A-286, and A962, version 1), as well as a casting 380 mm in diameter A962, version 2) produced by vacuum-induction melting, followed by electron-beam remelting. Before working a cast billet made of the A962 alloy, it undergoes-heterogeneous annealing at 1180° C. for 4 hours, followed by cooling in the furnace down to 870° C. at a rate of 5–10% per hour and then in the air. As a result of such heat-treatment, the dispersed γ-phase with the 0.5 micron grain size is precipitated in a coarse-grained (150 micron) matrix (γ-phase). Billets from the 3698, A962 (version 1), and A975 alloys are also subjected to heterogeneous annealing by being heated to a temperature exceeding the temperature of the γ-phase complete dissolution by 20–50° C., held for 2–4 hours, followed by low-rate cooling down to 700–800° C. As a result of the heterogeneous annealing, a homogeneous coarse-grained microstructure is established in said alloys, having a grain size of 50–150 micron, inside which grains a maximum amount of the coagulated γ-phase is uniformly precipitated.

Size control of the γ and γ-phases and volume fraction control of the γ-phase are carried out by the quantitative metallographic techniques. For nickel-base alloys differing in chemical composition and in the amount of the strengthening γ-phase, there are plotted empirical characteristic curves representing the size and the amount of γ-phase against the heating temperature, holding time, cooling and strain rates. These curves are used in selecting specific technological process conditions.

In order to obtain fine-grained microstructure of billets, they are subjected to thermomechanical processing under different conditions specified in the examples that follow.

EXAMPLE 1

A heterogeneous casting from the A962 alloy (version 2) undergoes thermomechanical processing with a stage-by-stage reduction of the working temperature from 1125 down to 1040° C., followed by post deformation annealing from 1100 down to 1030° C. At the first stage the casting having 380 mm in diameter is press-reduced at a temperature of 1125° C. at which the γ-phase content of the alloy is 10%, to a diameter of 200 mm, which corresponds to a change in the initial billet cross-section multiple of 3.6. Then the thus-reduced billet is upset in three stages in an isothermal die-set on a press with a force of 1600 tf at a temperature ranging from 1100 to 1025° C. A change in the degree of the billet reduction, while going from one upsetting stage to another, is proportional to a change in the cross-sectional billet area obtained at the preceding stage by 1.3, 1.5, and 2.5, respectively. The holding time is from 4 to 8 hours. With a stage-by-stage decreasing of the working temperature from 1100 to 1025° C. at each stage, consisting of reduction and subsequent annealing, a gain in the γ-phase equals 6–8%. Thus, the working of a billet under the preselected conditions results in that a homogeneous fine-grained microstructure of the microduplex-type with the grain size of the γ- and γ-phases equalling 2.5 and 1.3 micron, respectively, is established virtually in the entire volume of the worked billet, the γ-phase volume fraction being 31% (FIG. 1*a*).

EXAMPLE 2

Hot press-forged billet 150 mm in diameter and 300 mm in height, made of the A975 alloy undergoes thermomechanical processing with a stage-by-stage (in four stages) decrease of the working temperature from 1150 (17% content of the γ-phase) down to 1025° C. Thermomechanical processing is carried out at the first and second stages with a 45–90° turn of the direction of upsetting, a total degree of reduction at a next stage being equivalent to a degree of reduction proportional to a change in the cross-sectional area at the preceding stage by not more than 3.9 times. The annealing temperature ranges from that of deformation but not below it by more than 50° C., while a gain in the γ-phase at each stage is below 10%, and the holding time is 6–24 hours. Thermomechanical processing in a temperature range from 1150 to 1080° C. results in establishing a microduplex structure with the grain size of the γ- and γ-phases equal to 4.7 and 2.6 micron, respectively, and with the γ-phase volume fraction equal to 32%. Further working temperature decrease down to 1060–1025° C. results in additional precipitation of the γ-phase and in refining of the microstructure. The degree of reduction at stage 3 and stage 4 is equivalent to that proportional to a change in the cross-sectional area by 2 and 2.5 times, respectively. As a result of working in a temperature range from 1060 to 1025° C. a microduplex-type structure is obtained with the grain size of the γ- and γ-phases equalling 3 and 2.2 micron, respectively, and the γ-phase volume fraction equal to 46% (FIG. 1*b*).

EXAMPLE 3

Figure 2:
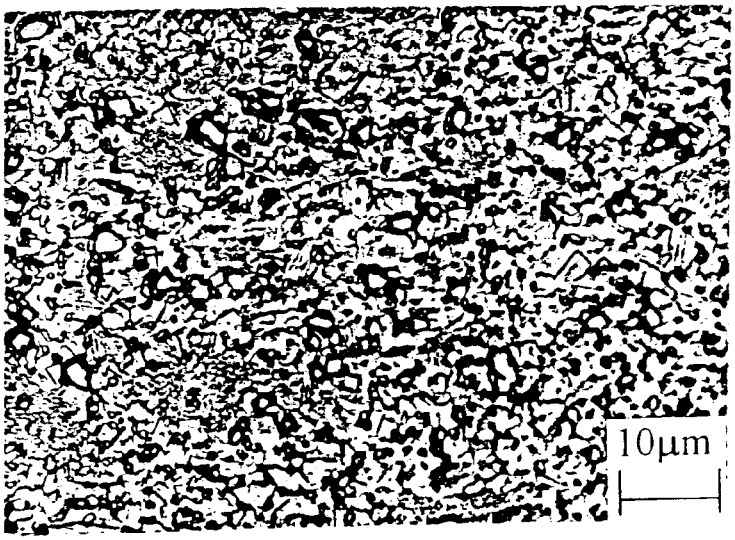
FIG. 2 shows the microstructure of the 3698 (a) and A-286 (b) alloys after thermomechanical processing.
Figure 2:
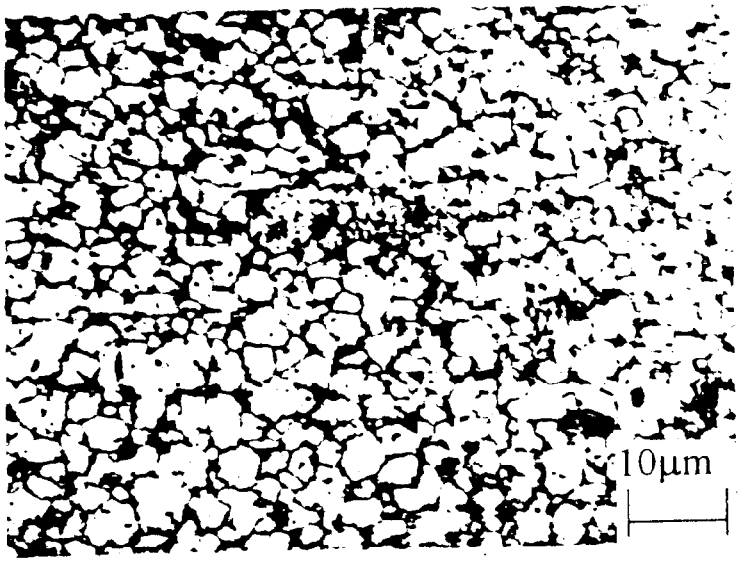

Hot-forged billets made of the 3698 alloy, 150 mm in diameter and 250 mm in height undergo thermomechanical processing. with a stage-by-stage (in two stages) decrease of the working temperature from 975° C. (12% content of the γ-phase) down to 900° C. The degree of reduction at stage 1 and the following stage 2 is equivalent to that proportional to a change in the cross-sectional area by 2.5 and 2 times, respectively. Postdeformation annealing is performed at 930 and 900° C. for 2–3 hours. A gain in the γ-phase at each stage is 5 and 2%. After the thermomechanical processing a microduplex structure is formed in a billet 340 mm in diameter and 50 mm in height, with the grain size of the γ- and γ-phases equal to 3.5 and 1.1 micron, respectively and a volume fraction of the latter phase equal to 19% (FIG. 2*a*).

EXAMPLE 4

Billets from the A-286 alloy having a diameter of 150 mm and a height of 250 mm undergo stage-by-stage decrease of the working temperature from 1000° C. (above the temperature of the γ-phase complete dissolution) to 825° C. Thermomechanical processing is carried out at the first and second stages with a 45–90° turn of the direction of upsetting, a total degree of reduction at a next stage being equivalent to a degree of reduction proportional to a change in the cross-sectional area at the preceding stage by not more than 3.9 times. Thermomechanical processing in a temperature range of 1000 to 900° C. results in establishing a fine-grained structure with the grain size of the γ-phase equal to 4.2 micron. Deformation at stages 3 and 4 proceeds at a temperature up to 850° C. and that of 830° C., when more than 7% of the secondary phases (γ- and γ-phases) is present in the A-286 alloy, with a degree of reduction equivalent to that multiple of a change in the billet cross-sectional area by 2 and 2.5 times, respectively. Postdeformation annealing occurs at 840 and 820° C. for 1 to 1.5 hours. As a result of thermomechanical processing in a temperature range of from 850 to 800° C., a fine-grained microstructure is established with the matrix grain size of 2.7 micron and second-phase grain size of 0.9 micron, with a volume fraction of the latter being 11%. A gain in the γ-phase at the working temperature below the temperature of the γ-phase complete dissolution is 1–2% (FIG. 2*b*).

EXAMPLE 5

A hot-forged billet from the A962 alloy prepared as in Example 1 undergo thermomechanical processing within a temperature of 1100 to 1025° C. in three stages. At the first stage the billet is worked at 1100° C. at a rate of $10^{-2}$ $s^{-1}$ with a twofold reduction of its initial cross-sectional area, whereupon the strain rate is decreased to $4.5 \cdot 10^{-3}$ $s^{-1}$ and the reduction proceeds until the ratio of 2.5 is attained, the deformation temperature being decreased to 1075° C. The second stage is effected in a temperature range of 1075 to 1050° C. with a reduction ratio of 2.0. At the end of the second stage the strain rate is decreased to $2 \cdot 10^{-3}$ $s^{-1}$ at which the reduction process proceeds to the end of the stage. The third stage is carried in a temperature range of from 1050 to 1025° C. till a reduction ratio of 1.5 at a strain rate of $2 \cdot 10^{-3}$ $s^{-1}$; afterwards the strain rate is decreased to $0.8 \cdot 10^{-3}$ $s^{-1}$ at which the reduction process proceeds until a final reduction ratio of 2.0 is attained. The embodiment stated is very efficient as producing a billet with a fine-grained microstructure (2 to 5 micron) per single continuous technological cycle of billet reduction under strictly controlled temperature-rate conditions.

EXAMPLE 6

A cast billet from the A962 alloy undergoes homogenization, whereupon it is subjected to reduction in a temperature range of from 1180 to 1120° C. with a stage-by-stage temperature decrease of the reduction temperature. At the first stage the billet is worked in a temperature range from 1180 to 1150° C. at a strain rate of $10^{-2}$ $s^{-1}$. The billet is worked with a 45–90° turn of the direction of reduction and a total reduction ratio equivalent to 3.5. The second stage of billet reduction proceeds in a temperature range from 1150 to 1120° C. and a strain rate of $4 \cdot 10^{-3}$ $s^{-1}$. Further thermomechanical processing occurs in a two-stage region with the γ-phase content above 7% under the conditions specified in Example 1. As a result of said processing, the microduplex-type microstructure is established in the processed billet, similar to Example 1.

EXAMPLE 7

The present Example is to illustrate thermomechanical processing of a billet in a heat-insulating container. The material of said container is steel, grade 12X18H10T which displays, under the temperature-rate reduction conditions used, the yield stress 25 to 50% that of the grade A962 coarse-grained alloy. A heat-insulated billet is placed in the container to be worked together therewith. A heat-insulating shell interposed between the billet and container is essentially a spacer consisting of a glass cloth and a heat insulant of the type of kaolin wool. The top and bottom container bases are sectionalized and made of the same steel grade with an intermediate layer of glass enamel.

The container-enclosed billets are heated in a furnace to the deformation temperature, whereupon they are upset in three stages on mandrels made of the 5XHM alloy and heated to 350° C., in a press with a force of 1600 tf within a temperature range from 1100 to 1040° C. A change in the degree of reduction in going from one upsetting stage to another is proportional to a change in the billet cross-sectional area at a preceding stage by 1.3; 1.5; and 2.5, respectively. At the first stage the strain rate equals $10^{-2}$ $s^{-1}$, while at the following stage the strain rate is selected according to the aforestated relationship, the empirical coefficient $K_{\phi}$, being 0.5. The holding time is 4 to 8 hours. In a stage-by-stage decrease of the working temperature from 1100 down to 1025° C. a gain in the γ-phase is 6–8% at each stage comprising billet reduction and the following annealing. Use of the aforesaid heat-insulating container allows of producing an upset crack-free billet with a fine-grained structure similar to that of Example 1.

It is worth noting that thanks to the use of plastic spacers the round-the-face billet areas are in fact completely processed, whereas in case of conventional containerless upsetting the zones of impeded deformation are formed in said areas, wherein the original coarse-grained microstructure is liable to persist rather frequently.

Thus, as a result of processing the billets under the conditions stated in Examples 1–7, fine-grained microstructures are therein formed, whereby superplastic properties are exhibited by the processed billets compared to their initial coarse-grained state (see Table 2).

EXAMPLE 8

Figure 3:
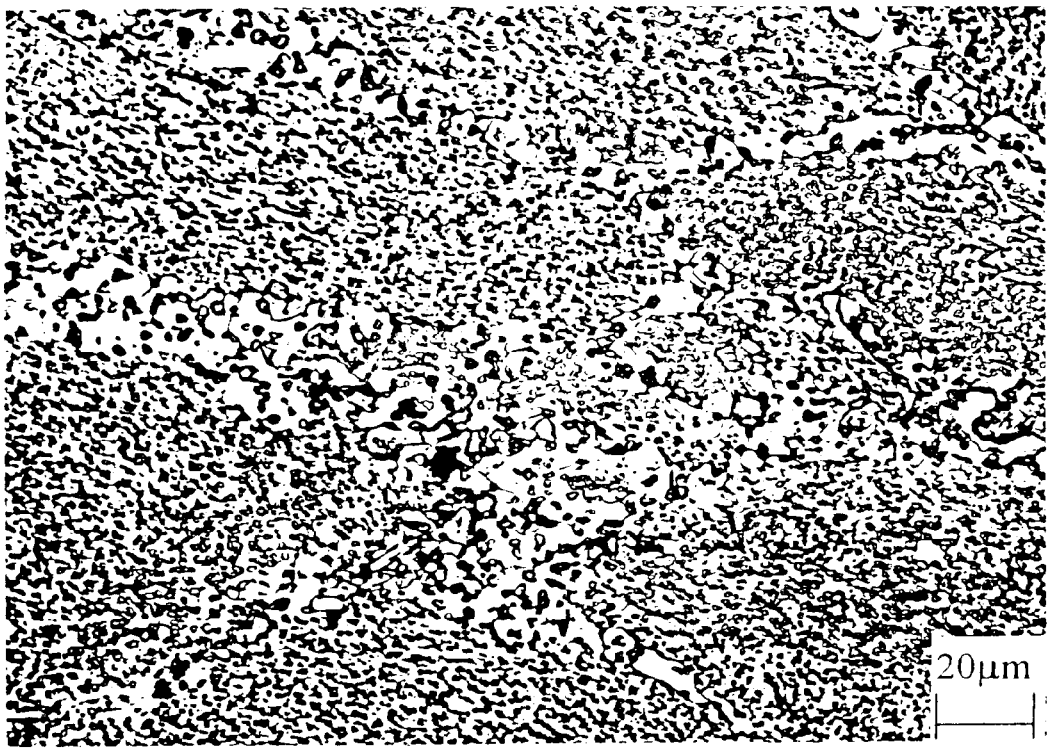
FIG. 3 illustrates the microstructure of a disk made of the, A962 alloy.
Figure 4:
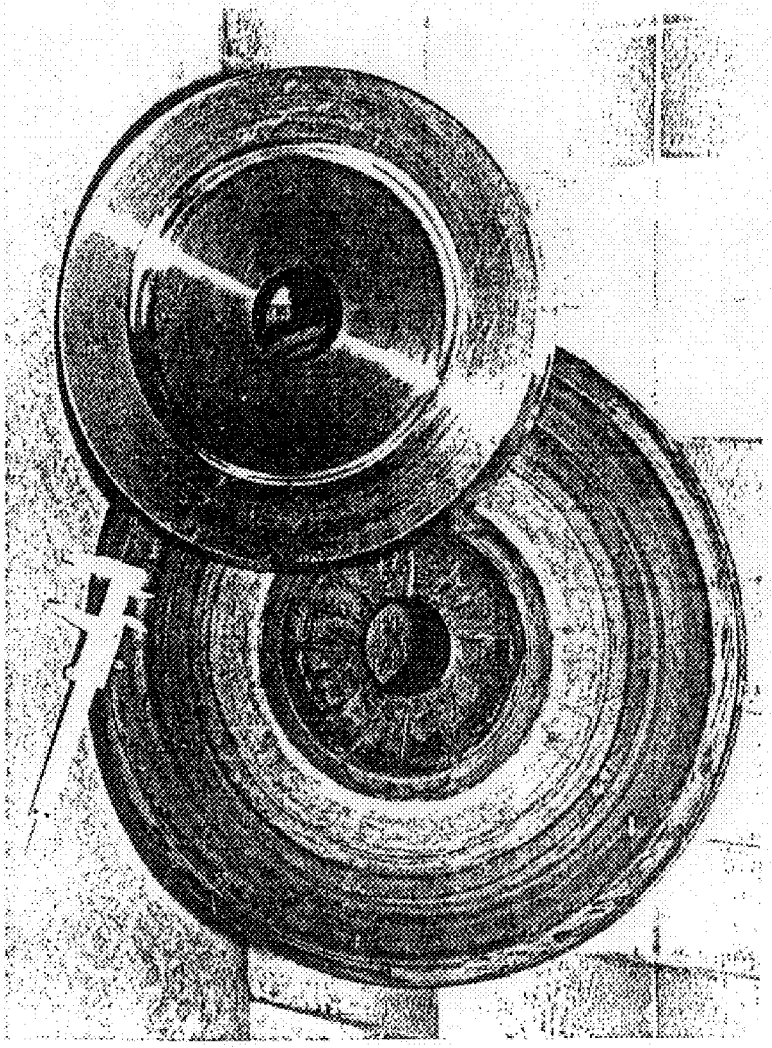
FIG. 4 presents a photographic picture of a disk made of the A962 alloy.
Figure 5:
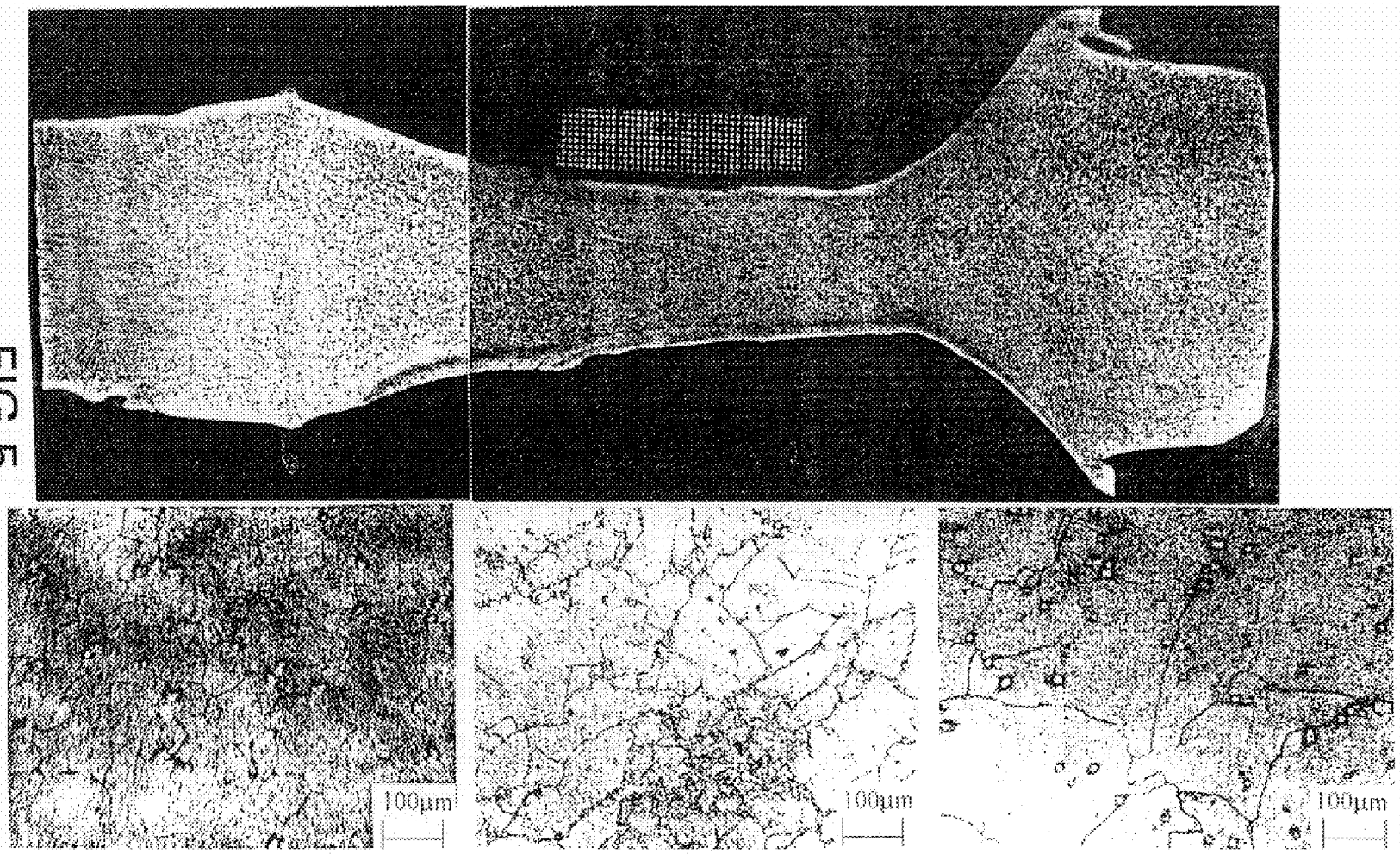
FIG. 5 shows the macro- and microstructure of a disk made of the specified-microstructure A962 alloy and produced by the local shaping technique.

Press-forged billets made from the A962 alloy undergo thermomechanical processing, said billets having a fine-grained microstructure (grain size of the γ- and γ-phases being 5.5 and 2.5 micron, respectively), and a coarse-grained microstructure (grain size of the γ- and γ-phases being 150 and 0.352.5 micron, respectively). The billet with an original fine-grained microstructure undergoes reduction at 1075° C. in a range of strain rates from $10^{-2}$ to $10^{-1}$ $s^{-1}$, while that with an original coarse-grained microstructure undergoes reduction at 1100° C. in a range of strain rates from $10^{-3}$ to $10^{-2}$ $s^{-1}$. Then disks are made from said billets, having a homogeneous fine-grained microstructure and that of the "necklace"-type (FIGS. 3, 5). The disk with a fine-grained microstructure is heat treated by being heated to a temperature above that of complete dissolution of the strengthening γ-phase (1145+10° C.), and the disk with specified microstructure, at 1100° C. Then both alloys are subjected to aging under the following conditions: holding at 850° C. for 6 hours, followed by air-cooling; holding at 800° C. for 16 hours, followed by air-cooling. After final heat-treatment the first disk with the original fine-grained microstructure exhibits a homogeneous coarse-grained microstructure, while the second disk displays more clearly the "necklace"-type microstructure which exhibits high complex of properties (Table 1).

EXAMPLE 9

Hot-forged billets from the A962 alloy, 200 mm in diameter and 350 mm in height undergo thermomechanical processing with a stage-by-stage (in 3 stages) decrease of the working temperature from 1100° C. (17% γ-phase) to 1060° C. The annealing temperature falls within the range of the deformation temperatures, but not below said temperature by more than 20° C., the gain in the γ-phase being below 10% at each stage. After thermomechanical. processing at temperatures from 1100 to 1060° C. upset billets 400 mm in diameter are obtained. The microstructure of the upset billets is of the microduplex type having a grain size of the γ- and γ-phases equal to 5.5 and 2.5 micron, respectively, the volume fraction of the latter phase equalling 26%. Then the furnace temperature is raised to the annealing temperature in the γ-phase monophase region and a temperature of 1170+10° C. is held therein for one hour. Next one billet is heated completely to 1170° C., whereas the other one is annealed under conditions of a temperature gradient between the various billet portions. The temperature of the billet hub (central) portion is maintained at 950° C. which equals about 0.8 the temperature of the γ-phase complete dissolution, by its being cooled-down. At the same time the temperature of the other (peripheral) billet portion corresponding to the web and rim of the disk being produced and located in the high-temperature furnace zone, is increased to the temperature not above 1.03 the temperature of the γ-phase complete dissolution (1170+10° C.) for one hour. Establishing a variable temperature field in billet, ranging from 0.8 the temperature of the γ-phase complete dissolution in one billet portion to 1.03 the temperature of the γ-phase complete dissolution in its other portion makes possible establishing a microstructure with the grain size increasing steadily from 5.5 micron in the billet central portion to 150 micron in the most heated billet peripheral portion. On the other hand, a coarse-grained microstructure is established in the entire volume of the first billet, having the grain size of 165 micron. Subsequent cooling from the annealing temperature to the temperature of 950° C. is carried out at a variable rate ensuring a gain in the γ-phase within the range of 26–17% per hour. As a result of heterogenizing annealing a coagulated γ-phase with the grain size of 0.3 to 0.4 micron precipitates uniformly inside the grains. Next a temperature of 1100° C. is set in the furnace and after heating the billets they are subjected to local shaping which is carried out under the temperature-rate conditions of superplasticity (1100° C., $\epsilon=10^{-}2–10^{-3}$ $s^{-1}$) with a 35–65% degree of reduction.

After having undergone reduction, the disks are oil-quenched from the final deformation temperature (1100+10° C.), and subjected to aging under the following conditions: holding at 850° C. for 6 hours, followed by air-cooling; holding at 800° C. for 16 hours, followed by air-cooling. Mechanical properties of the first disk in the respective zones are found to approximate those of the second disk as specified in Table 1.

A specific feature of the second disk, as has been found by an analysis of its microstructure and mechanical properties, consists in that the structure states (FIG. 5) varying steadily from one disk portion to another are formed in the various disk zones (i.e., hub, web, and rim). Thus, the hub displays a fine-grained microstructure with the grain size of 35 micron, the web has a "necklace" microstructure, and the disk rim features a coarse-grained microstructure with serrated grain boundaries. This provides a steady variation of the short-time and high-temperature strength properties. The transient disk portions from the hub to the web and from the web to the rim exhibit the values of short-time strength at room temperature and long-term strength at an elevated temperature (650° C.) approximating the average characteristics observed in the adjacent disk portions (Table 1).

EXAMPLE 10

Fine-grained structure forged billets obtained under the conditions specified in Example 9 are worked as follows. At the first stage the billets are subjected to working at 1075° C. to obtain an intermediate product having an outside diameter equal to 0.8 the final disk diameter. Then the temperature in the furnace is increased to 1170° C. (that is, by 20° higher than the temperature of the γ-phase complete dissolution), and the billets are held at that temperature for one hour. Next the billets are cooled at a variable rate providing a gain in the γ-phase changing within a range of 26–17% per hour, down to the deformation temperature. The working is performed at a strain rate up to $10^{-3}$ $s^{-1}$ at a temperature of 1100+20° C.

The temperature of the billet central portion is maintained below that of superplasticity throughout the working cycle. The deformation process is followed by heat-treatment of the disk by annealing directly from the deformation temperature with subsequent ageing. As a result of such thermomechanical processing a specified microstructure is established in the disk, similar to that described in Example 9 (that is, the microduplex one in the central portion, the "necklace"-type in the web, and the coarse-grained microstructure with serrated grain boundaries in the peripheral portion).

Thus, the proposed method, in view of an inhomogeneous disk heating during operation, provides formation of a microstructure therein which varies in a predetermined way and ensures a change in the set of the disk mechanical properties adequate to the temperature field variation.

INDUSTRIAL APPLICABILITY

Billets prepared by the method proposed in the present invention can find application for producing, by the plastic working techniques, various critical parts for power plants used in aerospace engineering, ship-building, and in the fuel-and-power industry.

TABLE 1

| Example No. | Disk portion where the specimen is cut from | T, ° C. | σ& MPa | $\sigma_{0.2}$ MPa | δ % | High-temperature strength at 650° C. $\sigma_n$, MPa | τ, hour |
|---|---|---|---|---|---|---|---|
| 8 | Hub | 20 | 1566 | 1220 | 16.4 | 1050 | 264 |
| | Web | 20 | 1562 | 1224 | 16.7 | 1050 | 280 |
| | Rim | 20 | 1560 | 1230 | 16.0 | 1050 | 296 |
| 9 | Hub | 20 | 1610 | 1180 | 17.2 | 1020 | 101 |
| | Web | 20 | 1590 | 1260 | 18.3 | 1050 | 276 |
| | Rim | 20 | 1560 | 1255 | 14.6 | 1100 | 128 |
| 9 | Hub-to-web transition area | 20 | 1570 | 1199 | 15.4 | 1050 | 270 |
| 9 | Web-to-rim transition area | 20 | 1538 | 1238 | 13.4 | 1080 | 179 |
| 10 | Hub | 20 | 1590 | 1173 | 16.3 | 1000 | 172 |
| | Web | 20 | 1581 | 1263 | 16.9 | 1050 | 250 |
| | Rim | 20 | 1540 | 1240 | 15.8 | 1080 | 115 |

T — test temperature
σ& — test tensile strength of the material
$\sigma_{0.2}$ — test tensile yield point
δ — specimen percentage elongation at rupture
σ — stress applied to specimen under temperature strength test

TABLE 2

| Alloy | State | T, ° C. | ε, $s^{-1}$ | $\sigma_{40\ MPa}$ | δ, % | m |
|---|---|---|---|---|---|---|
| ]3698 | K3 | 950 | $10^{-3}$ | 190 | 80 | 0.21 |
| | M3 | 950 | | 120 | 320 | 0.4 |

TABLE 2-continued

| Alloy | State | T, ° C. | ε, $s^{-1}$ | $\sigma_{40\ MPa}$ | δ, % | m |
|---|---|---|---|---|---|---|
| ]A962 | K3 | 1050 | $10^{-3}$ | 220 | 89 | 0.23 |
| | M3 | 1050 | | 40 | >500 | 0.6 |
| ]A975 | K3 | 1100 | $10^{-3}$ | 140 | 94 | 0.19 |
| | M3 | 1100 | | 20 | >550 | 0.8 |

K3 — coarse-grained state
M3 — post-TMP fine-grained state
ε — strain rate
$\sigma_{40}$ — tensile test yield stress at 40% degree of deformation
δ — specimen percentage elongation at rupture
m — coefficient of yield stress rate sensitivity

What is claimed:

1. A method for processing a billet, comprising the following steps:

heating the billet to a treatment temperature at which a total content of precipitates exceeds 7%;

subjecting the billet to a first stage deformation at a first stage treatment temperature to reduce billet cross-sectional area by about 1.2 to 3.9 times;

subsequent stage-by-stage reduction of the treatment temperature down to a temperature of formation of a stable fine-grained microstructure, a ratio between grain sizes of different phases in each stage not exceeding 10;

subjecting the billet to deformation at each stage of subsequent temperature reduction so as to reduce billet cross-sectional area by about 1.3 to 2.5 times per stage; and subjecting the billet to annealing after each stage;

wherein the strain rate at the first treatment stage ranges from $10^{-2}$ to $10^{-3}$ $s^{-1}$, and the strain rate at the following stages is set in accordance with the following relationship $$\epsilon_{\eta}=K_{\phi}\cdot\epsilon_{\eta\rho}\cdot T_d/T_{\eta\rho\phi}$$

where $\epsilon_{\eta}$—strain rate at a next stage;

$\epsilon_{\eta\rho}$—strain rate at a preceding stage;

$T_d$—next stage deformation temperature:

$T_{\eta\rho\phi}$—temperature of the second phase complete dissolution; and $K_{\phi}$—empirical coefficient depending on the chemical and phase composition of the alloy.

2. A method as set forth in claim 1, wherein a stage-by-stage reduction of the treatment temperature of a nickel-based alloy billet is performed by providing a maximum increase in an amount of a γ-phase at each stage up to and including about 14%, and each stage of the thermomechanical treatment is followed by a post-deformation annealing at a temperature not exceeding the temperature of the beginning of deformation at a preceding stage of treatment.

* * * * *